US006349890B1

(12) United States Patent
Godsey

(10) Patent No.: US 6,349,890 B1
(45) Date of Patent: Feb. 26, 2002

(54) FLAKER MILL HAVING HIGH EFFICIENCY DRIVE

(75) Inventor: Ivan Godsey, Topeka, KS (US)

(73) Assignee: IBT, Inc., Merriam, KS (US)

( * ) Notice: Subject to any disclaimer, the term of this patent is extended or adjusted under 35 U.S.C. 154(b) by 0 days.

(21) Appl. No.: 09/531,459

(22) Filed: Mar. 20, 2000

(51) Int. Cl.[7] ..... B02C 4/06
(52) U.S. Cl. ..... 241/232; 241/231
(58) Field of Search ..... 241/232, 231, 241/101.2

(56) References Cited

U.S. PATENT DOCUMENTS

| | | | | |
|---|---|---|---|---|
| 2,023,623 A | * | 12/1935 | Straug | 241/232 |
| 2,366,619 A | * | 1/1945 | Harrison | 241/232 |
| 3,208,678 A | * | 9/1965 | Pick | 241/232 |
| 5,823,452 A | | 10/1998 | Ballew et al. | 241/232 |

FOREIGN PATENT DOCUMENTS

| | | | | |
|---|---|---|---|---|
| BE | 554384 | * | 2/1957 | 241/232 |

OTHER PUBLICATIONS

Overly Hautz Motor Base Company Dimension Sheet No. MR–200–2 (Published at least as early as Dec. 18, 1998).
The PT Motion Systems Distributor, "Pushing Belt Drive Efficiency", pp. 35–38 (May/Jun. 1998).
Ferrel–Ross Brochure entitled "Materials Reduction, Recovery and Recycling for Industry and Government", (Published at least as early as Dec. 18, 1998).

* cited by examiner

*Primary Examiner*—Daniel C. Crane
(74) *Attorney, Agent, or Firm*—Hovey, Williams, Timmons & Collins

(57) ABSTRACT

The material processing mill includes a pair of rolls that each preferably have a smooth outer surface, such that material particles passing through the nip defined between the rolls are formed into flakes. One of the rolls is shiftable relative to the other, and shifting of the one roll is controlled by a roll positioning mechanism that includes a pair of piston and cylinder assemblies and associated spring reliefs. The rolls are each powered by a separate drive, which preferably includes a motor drivingly connected to the respective roll by a cogged belt. The drive for the shiftable roll particularly includes a motor base having a shiftable carrier to which the motor is fixed. The drive further includes a belt tensioning device, preferably in the form of a turnbuckle, that adjustably fixes the motor to the shiftable roll. Thus, the motor normally shifts with the shiftable roll, but the tensioning device may be used to adjust the spacing between the motor and shiftable roll to vary the tension on the belt. The piston and cylinder assemblies are single acting and are consequently capable of powering the shiftable roll in only one direction, and the motor base includes a biasing mechanism to urge the motor and roll in the opposite direction.

19 Claims, 2 Drawing Sheets

FLAKER MILL HAVING HIGH EFFICIENCY DRIVE

BACKGROUND OF THE INVENTION

1. Field of the Invention

The present invention relates generally to material processing mills having a pair of rotating rolls between which material is processed. More particularly, the present invention concerns an improved drive arrangement that provides relatively high drive efficiency and unprecedented durability.

2. Discussion of Prior Art

A material processing mill (e.g., a flaker or roller mill) traditionally includes a pair of rolls defining a nip therebetween. One of the rolls is traditionally shiftable relative to the other so that the size of the nip can be varied. This not only permits adjustment of the nip size, but a spring relief may be provided so that the shiftable roll is yieldably maintained in the desired position and can shift relative to the other roll when a large object passes through the nip. Those ordinarily skilled in the art will also appreciate that the actual manner in which material passing through the nip is processed depends on, among other things, the size of the nip, the configuration of the roll, the speeds of the rolls, etc. For example, a roller mill typically includes a pair of corrugated rolls that rotate at different speeds to comminute the material. On the other hand, a flaker mill normally uses smooth rolls rotated at the same speed to press the material into flakes, although some flaker mills use corrugated rolls such as those used in the cattle feed industry.

In any case, conventional material processing mills have heretofore utilized a single belt drive to rotate both rolls. The standard mill drive includes a single stationary motor and, because the rolls desirably rotate in opposite directions, a "back-wrapped" V-belt. In other words, the belt is disposed along a serpentine path It has been determined that this drive arrangement presents numerous problems. For example, drive components, such as bearing assemblies and shafts, have been known to fail prematurely. Furthermore, the standard mill drive is believed to be terribly inefficient.

OBJECTS AND SUMMARY OF THE INVENTION

Responsive to these and other problems, an important object of the present invention is to provide a drive for rotating the rolls of a material processing mill that is more efficient than standard mill drives. It is also an important object of the present invention to provide a mill drive that does not prematurely fail. Another important object of the present invention is to provide a material processing mill having these drive advantages. Yet another important object of the present invention is to provide a mill drive that is durable, simple in construction, and inexpensive.

In accordance with these and other objects, the present invention concerns a material processing mill that includes a separate drive for each of rolls. Each drive includes a motor, a rotatable drive member drivingly connected to the motor, a rotatable driven member fixed relative to the respective one of the rolls, and an endless positive drive element that drivingly connects the driven member to the drive member. Contrary to initial thoughts, this dual drive arrangement provides numerous unexpected advantages. For example, the elimination of the serpentine belt arrangement (required in a single drive mill to reverse the rotational direction of one of the rolls) surprisingly saves cost and simplifies the construction, even though two separate drives are provided. Moreover, the positive drive element used in each of the drives is believed to significantly improve the transfer of power from the motor to the respective roll. It is further believed that the individual drives will enjoy significantly longer maintenance free operation than conventional mill drives. This is apparently attributable to, among other things, the fact that the positive drive belt does not require the same degree of tensioning as the standard V-belt. Yet another advantage is the that the user is given greater flexibility on controlling the relative rotational speeds of the rolls.

The present invention also contemplates the use of a unique motor base that shiftably supports the motor associated with the shiftable roll. The motor includes a carrier to which the motor is fixed so that the motor is free to shift while rotating the shiftable roll. The motor and shiftable roll are preferably interconnected by an element tensioning device that is operable to adjust the tension of the element drivingly connecting the roll to the motor. The tensioning device adjustably fixes the motor relative to the shiftable roll so that the spacing between the motor and the shiftable roll is selectively variable. Thus, the motor and the shiftable roll shift together except when the tensioning device is adjusted to vary the tension of the belt. Because the motor normally shifts with the roll, the tension of the element remains constant as the roll shifts to its various positions. That is to say, if the motor did not shift with the roll, the tensioning device would need to be configured to "over-tension" the element when the roll is closest to the motor. This would ensure that the element would be sufficiently tensioned when the roll is furthest from the motor.

Other aspects and advantages of the present invention will be apparent from the following detailed description of the preferred embodiments and the accompanying drawing figures.

BRIEF DESCRIPTION OF THE DRAWING FIGURES

A preferred embodiment of the invention is described in detail below with reference to the attached drawing figures, wherein.

Figure 3:
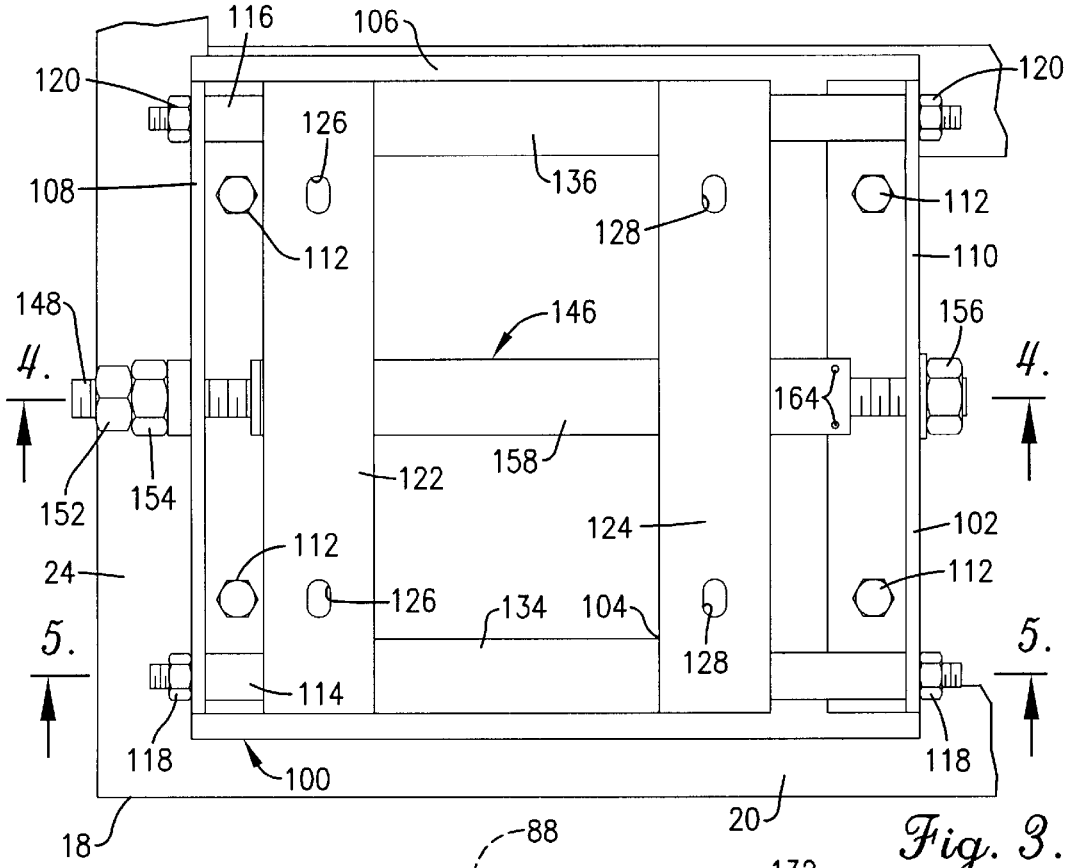
FIG. 3 is a enlarged, fragmentary, plan view of a portion of the mill, particularly illustrating the motor base of the drive for the shiftable roll with the motor being removed.
Figure 4:
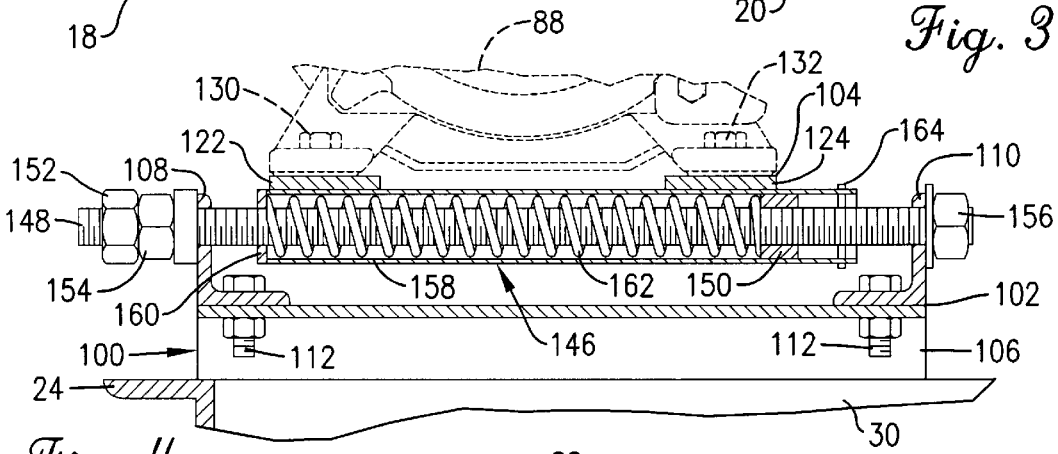
Figure 5:
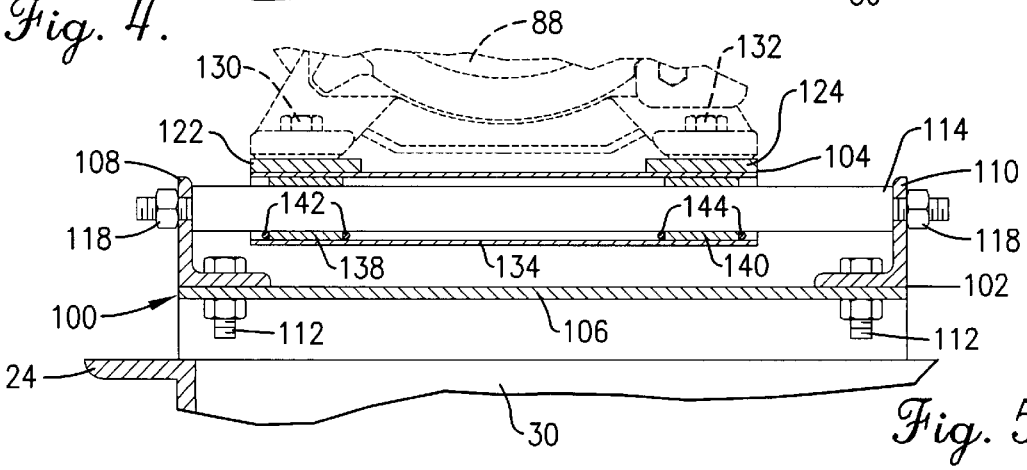

FIG. 4 is a cross-sectional view of the motor base taken generally along line 4—4 of FIG. 3, particularly illustrating the biasing mechanism for urging the motor and shiftable roll in a direction corresponding to an increase in the nip; and FIG. 5 is a cross-sectional view of the motor base taken generally along line 5—5 of FIG. 3, particularly illustrating the manner in which the carrier is shiftably supported on the mount.

DETAILED DESCRIPTION OF THE PREFERRED EMBODIMENT

The material processing mill 10 selected for illustration includes a pair of rotatable rolls 12 and 14 (shown primarily in phantom in FIGS. 1 and 2) defining a nip 16 therebetween. As will subsequently be indicated, material is delivered to the nip 16, and the rolls 12 and 14 serve to process the material passing therethrough. The manner in which the material is processed depends on such factors as the configuration of the outer surfaces of the rolls, the relative speeds of the rolls, the size of the nip 16, etc. In the illustrated embodiment, each of the rolls 12 and 14 has a smooth outer surface. Furthermore, the rolls 12 and 14 are the same size and rotate at the same speed. Material particles passing through the nip 16 are consequently pressed into flakes, and the illustrated mill 10 will consequently be referred to as a flaker mill. It will be appreciated, however, that the principles of the present invention are equally applicable to various other types of mills, as well as other mill configurations. For example, it is entirely within the ambit of the present invention to alternatively configure the mill 10 to comminute material particles passing therethrough. In this application, the mill would likely include two corrugated rolls rotated at different speeds (similar to a roller mill).

Figure 1:
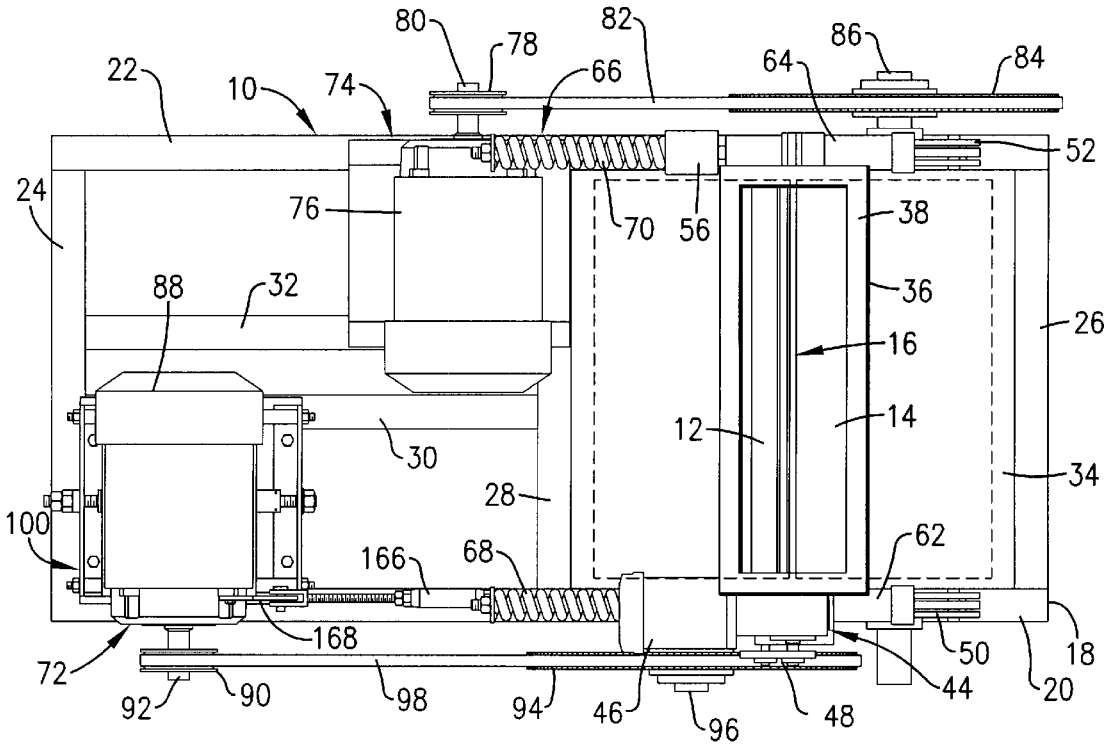
FIG. 1 is a plan view of a flaking mill constructed in accordance with the principles of the present invention, particularly illustrating the separate drives for the processing rolls.

With the foregoing caveat in mind, the illustrated flaker mill 10 includes a frame 18 that has a generally rectangular configuration (see FIG. 1). The frame includes a pair of spaced apart side beams 20 and 22. Extending between the side beams are a pair of end beams 24,26 and a central beam 28 spaced equally between the end beams 24 and 26. A pair of intermediate beams 30 and 32 interconnect the end beam 24 and the central beam 28, with the intermediate beams 30,32 being parallel to the side beams 20,22 and spaced slightly apart on opposite sides of the longitudinal axis of the frame 18. The beams 20–32 are all preferably formed of the same material and, as perhaps best shown in FIG. 2, each of the beams has a generally U-shaped cross section to present an upright web extending between a pair of horizontal flanges. The beams 20–32 are preferably formed of metal and interconnected by suitable means (e.g., welding), although other beam materials and assembly techniques may be used. In fact, the frame 18 may be entirely eliminated, if desired, and the other mill components may be mounted to any other suitable structure.

A generally box-like casing 34 is supported on the frame 18 between the end beam 26 and central beam 28. The casing 34 houses the rolls 12 and 14, such that material processing is generally contained within the casing 34. In the usual manner, the casing 34 has a bottom discharge opening (not shown) or presents an entirely open bottom through which material exits the mill 10. A material inlet conduit 36 projects upwardly from the top wall of the casing 34 as perhaps best shown in FIG. 1, the inlet conduit 36 is generally aligned with the nip 16 so that material flowing through the conduit 36 falls into the area between the rolls 12 and 14. The conduit 36 has an upper flange 38 that connects to the flange 40 of a material hopper 42 (see FIG. 2). In view of the foregoing, the operation of the flaker mill 10 relies on gravitational material flow from the hopper 42 and through the mill 10.

A feeder 44 is associated with the inlet conduit 36 for controlling material flow to the casing 34. As is customary, the feeder includes a motor 46 and a feeder drive 48 drivingly connecting the motor 46 to a rotatable element (not shown) extending across the conduit 36 (note, the rotatable element has been removed from FIG. 1 so that the nip 16 is visible). The rotatable element traditionally comprises a corrugated roll (i.e., used in a so-called "roll feeder") or a rotating shaft with radially projecting metal fingers (i.e., used in a so-called "pin feeder"). In any case, the rotatable element preferably controls the rate at which product is delivered to the rolls 12 and 14 and uniformly distributes the product along the entire length of the rolls. It is noted that the principles of the present invention are equally applicable to a mill that does not include a feeder. For example, material flow to the mill may alternatively be controlled upstream from the inlet conduit.

Figure 2:
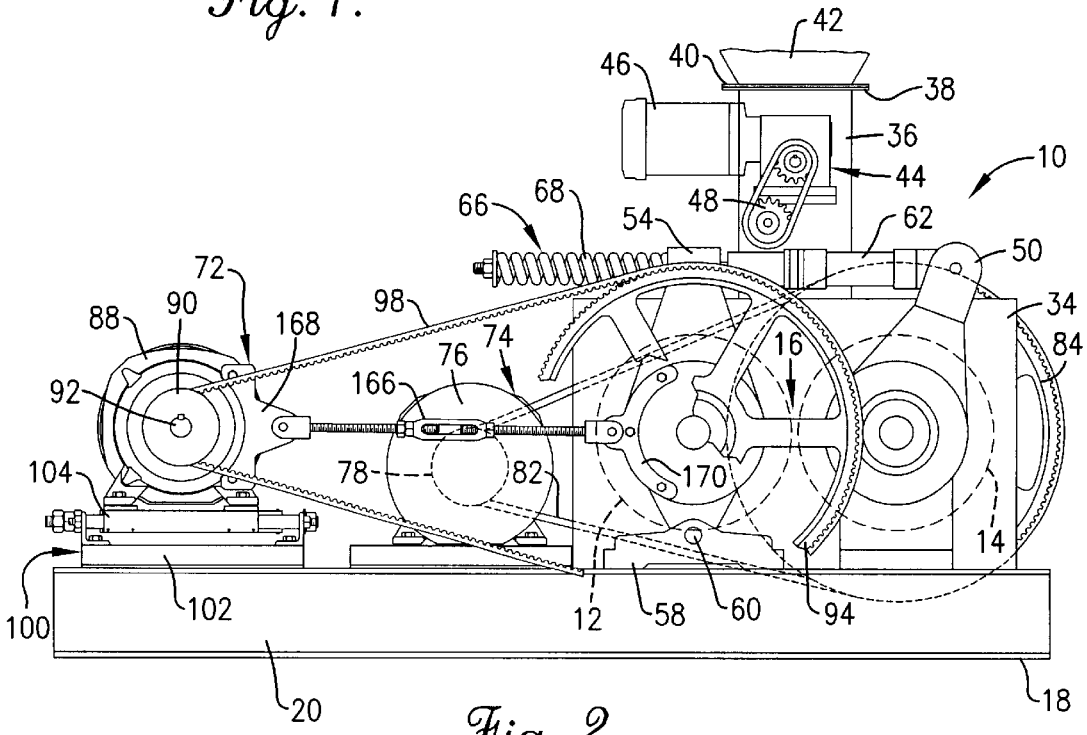
FIG. 2 is a side elevational view of the flaking mill.

In the usual manner, one of the rolls 12,14 rotates about a fixed axis and the other rotates about a relatively shiftable axis so that the nip 16 may be adjusted, although the principles of the present invention are equally applicable to a mill having both rolls rotating about shiftable axes. With particular respect to the illustrated embodiment, the roll 14 is "fixed" so as to rotate about a stationary axis. A pair of fixed support arms 50 and 52 located exteriorly of the side walls of the casing 34 are mounted to the side beams 20 and 22, respectively. The roll 14 is journaled for rotation between the arms 50 and 52. On the other hand, the "shiftable" roll is rotatably supported between a pair of swingable arms 54 and 56. As shown in FIG. 2, an arm support stand 58 mounted on the side beam 20 provides a laterally extending pivot 60 about which the arm 54 swings. Although not shown, the arm 56 is similarly supported. It is particularly noted that the roll 12 interconnects the swingable arms 54 and 56 and thereby causes them to swing together.

As is also customary, the flaker mill 10 includes a roll positioner that generally controls swinging of the arms 54 and 56 and thereby the location of the roll 12. Those ordinarily skilled in the art will appreciate that this permits the user to adjust the nip 16. In the preferred embodiment, the roll positioner includes a pair of linear power mechanisms 62 and 64 each being pivotally connected to an upwardly and outwardly inclined portion of a respective one of the arms 50 and 52. The power mechanisms 62 and 64 are preferably hydraulic piston and cylinder assemblies, although other power mechanisms (e.g., a pneumatic piston and cylinder assemblies, a solenoid, etc.) may be used. It is also noted that the mill 10 may alternatively be provided with only one piston and cylinder assembly.

In the illustrated embodiment, the roll positioner includes a spring relief 66 that serves to yieldably maintain the shiftable roll 12 in the desired position. In particular, once the shiftable roll 12 has been positioned by the piston and cylinder assembly 62 and 64, it is still capable of shifting away from the fixed roll 14 against the bias of relief 66. This permits large objects to pass through the nip 16 without damaging the rolls 12 and 14. In the conventional manner, the spring relief 66 includes a pair of springs 68 and 70 each being retained between a corresponding one of the swingable arms 54 and 56 and the rod end of a corresponding one of the piston and cylinder assemblies 62 and 64. The swingable arms 54 and 56 are shiftably connected to the rods of the piston and cylinder assemblies 62 and 64, respectively, with stops (not shown) being provided to limit such relative movement of the arms 54 and 56 in a direction toward the fixed arms 50 and 52 (i.e., in a rightward direction when viewing FIGS. 1 and 2). Thus, the stops essentially define the position at which the shiftable roll 12 is yieldably maintained by the springs 68 and 70. For example, when it is desired to increase the size of the nip 16, the piston and cylinder assemblies 62 and 64 are extended. It will be appreciated that such shifting of the roll 12 should not compress or relieve the springs 68 and 70 because they shift with the arms.

In the illustrated embodiment, the piston and cylinder assemblies 62 and 64 are single acting, meaning they are powered in only one direction. It is particularly preferred that the assemblies 62 and 64 provide shifting power only as they retract, such that the roll 12 is only positively shifted by the assemblies 62 and 64 in a direction toward the fixed roll 14. Of course, it is entirely within the ambit of the present invention to use double acting cylinders that serve to positively shift the roll 12 in both directions. In any case, once the shiftable roll 12 has been positioned as desired, the assemblies 62 and 64 are preferably hydraulically locked so that the roll 12 is prevented from further shifting except for that provided by the spring relief 66.

Turning now to the means by which the rolls 12 and 14 are driven, the illustrated flaker mill 10 includes an inventive dual drive arrangement comprising separate drives 72 and 74 for the rolls 12 and 14, respectively. Turning first to the drive 74 for the fixed roll 14, a motor 76 is mounted in a conventional manner on a stationary motor base 77 fixed to the frame 18. A drive sheave 78 mounted on the output shaft 80 of the motor 76 is entrained by a positive drive belt 82 (e.g., a cogged or toothed belt) (see FIG. 1). The belt 82 also wraps around a relatively large driven sheave 84 fixed to the stub shaft 86 of the roll 14. Proper tensioning of the belt 82 may be accomplished in any suitable manner. For example, the drive 74 may be provided with a spring-biased idler (not shown) that yieldably presses against the belt 82. It is alternatively possible to configure the motor base 77 so that the motor 76 is adjustably fixed thereto. In this arrangement, the operator positions the motor 76 relative to the driven sheave 84 to suitably tension the belt 82 and then securely anchors the motor 76 to the base 77. Only after the motor 76 is fixed to the base 77 is the drive 74 operated. Such a "belt-tensioning motor base" is available from Overly Haute Motor Base Company from Lebanon, Ohio under the designation adjustable steel motor rails. It is finally noted that the principles of the present invention are equally applicable to various other endless, positive drive elements for drivingly interconnecting the roll 14 and motor 76 (e.g., a chain).

The drive 72 for the shiftable roll 12 similarly includes a motor 88, a drive sheave 90 fixed to the output shaft 92 of the motor 88, a relatively larger driven sheave 94 fixed to the stub shaft 96 of the roll 12, and a cogged belt 98 entraining the sheaves 90 and 94. These drive components may be variously and alternatively configured as noted above with respect to the drive 74.

Moreover, the drive 72 includes a motor base 100 that permits shifting of the motor 88 during mill operation. The base 100 generally includes a mount 102 fixed to the frame 18 and a carrier 104 shiftably supported on the frame 102. As will subsequently be described, the carrier 104 fixedly supports the motor 88 thereon, such that the motor 88 is shiftable relative to the mount 102 and therefore the frame 18.

Turning specifically to the preferred construction of the mount 102, a footing 106 extends between and is fixed to the side beam 20 and intermediate beam 30 adjacent the end beam 24 (see FIGS. 3–4). The footing 106 preferably comprises an inverted U-shaped channel that presents a flat top surface against which a pair of supports 108 and 110 are secured. As perhaps best shown in FIGS. 4 and 5, the preferred supports 108 and 110 are each L-shaped and fastened to the footing 106 by fasteners 112. Extending between the upright flanges of the supports 108, 110 are a pair of spaced apart rails 114 and 116. The rail 114 preferably comprises a cylindrical shaft that has been turned down and then threaded adjacent its opposite ends. The threaded, reduced diameter ends of the rail 114 project through and outwardly beyond the supports 108 and 110, and nuts 118 are received on the ends to secure the rail 114 between the supports 108 and 110. The other rail 116 is preferably identical to the rail 114 and similarly fastened between the supports 108 and 110 by nuts 120.

The carrier 104 includes a pair of elongated mounting plates 122 and 124 on which the motor 88 is fixedly supported. The plates 122 and 124 include fastener openings 126 and 128 (see FIG. 3), respectively, with the motor 88 being fixed to the plates 122,124 by conventional nut and bolt assemblies 130 and 132 received in the respective openings 126 and 128. It is noted that the illustrated mounting plates are rectangular in shape and are spaced apart a distance corresponding to the spacing between the feet of the motor 88 (e.g., see FIGS. 4 and 5). Moreover, the plates 122 and 124 extend between and interconnect a pair of sleeves 134 and 136, each of which is slidably received on a respective one of the rails 114 and 116. As particularly shown in FIG. 5, the sleeve 134 includes bushings 138 and 140 adjacent opposite ends thereof, with each of the bushings 138 and 140 being fixed relative to the sleeve 134 and having an axial opening that corresponds with the exterior of the rail 114 so as to be slidable relative thereto. The bushings 138 and 140 are preferably fixed to the sleeve 134 by respective retaining pins 142 and 144, although the bushings may be connected to the sleeve in any other suitable manner (e.g., welding, press fit, etc.). Although not shown, it will be appreciated that the sleeve 136 is similarly configured to be slidably supported on the rail 116.

The motor base 100 further includes a biasing mechanism 146 as particularly shown in FIG. 4. The preferred biasing mechanism 146 is configured to urge the motor 88 in a leftward direction (when viewing FIG. 4). Most preferably, the biasing mechanism 146 includes a threaded rod 148 adjustably connected between the supports 108 and 110. A bushing 150 is received on the rod 148 between the supports 108 and 110, with the location of the bushing 150 preferably being adjusted by loosening the nuts 152,154,156 and then shifting the rod 148 relative to the supports 108 and 110. A tube 158 is slidably received over the threaded rod 148 and includes an end cap 160 that cooperates with the bushing 150 to retain a helical spring 162 therebetween. A stop in the form of a pair of pins 164 are attached to the tube 158 adjacent the end opposite from the end cap 160 to abuttingly engage the bushing 150 and thereby limit movement of the tube 158 relative to the threaded rod 148 in a leftward direction (when viewing FIG. 4). For purposes which will subsequently be described, the biasing mechanism 146 is configured to yieldably bias the motor 88 in a direction away from the rolls 12,14. As shown in FIG. 4, the bushing 150 is located to ensure that the spring 162 is compressed when the motor 88 in its various operating positions.

It is noted that the motor base 100 described herein is only an illustrative example of the present invention. That is, the principles of the present invention are equally applicable to various other motor base designs and constructions. It is important, however, that the base included shiftable carrier on which the motor is fixedly supported so that the motor is moveable during operation. Possible alternatives to the illustrated construction include a carrier comprising a single flat plate that is mounted directly on the mill frame by rollers. It is also possible to utilize a different biasing mechanism (e.g., a torsion spring retained between the carrier and the mill frame).

The drive 72 for the shiftable roll 12 further includes a belt tensioning device that is used to remove excess slack from the belt 98 so as to ensure driving power is transmitted from the drive sheave 90 to the driven sheave 94 (see FIG.

2). The tensioning device 166 is pivotally connected between a motor bracket 168 and an arm bracket 170. Moreover, the preferred tensioning device 166 is rigid and has a fixed length, except during adjustment, such that the motor 88 and support arm 54 shift together. Thus, shifting movement of the motor 88 corresponds with that of the roll 12. The illustrated tensioning device 166 comprises a turnbuckle that adjustably fixes the motor 88 relative to the roll 12. The turnbuckle 166 may be lengthened or shortened to shift the motor 88 relative to the roll 12 and thereby adjust the tension of the belt 98. The motor 88 is therefore normally fixed relative to the roll 12 and consequently shifts when the nip is adjusted or when large objects pass therethrough. Furthermore, the preferred tensioning device 166 ensures that the belt 98 remains suitably tensioned as the roll 12 shifts.

Because of the interconnection between the motor 88 and shiftable roll 12, the biasing mechanism 146 yieldably urges the shiftable roll 12 in a direction away from the fixed roll 14. However, the spring force provided by the mechanism 146 is sufficiently lower than the spring relief 66 so that the former does not effect the desired positioning of the roll 12. It is again noted that the piston and cylinder assembly 62 and 64 are single acting into only the retracted condition. Accordingly, the biasing mechanism 146 serves to shift the roll 12 in a direction away from the fixed roll 14. This is accomplished simply by relieving the pressure in the piston and cylinder assemblies 62 and 64 so that the spring 162 can cause the motor 88 and thereby the roll 12 to shift in a direction away from the fixed roll 14. It is also noted that the spring relief 66 will not restrict such shifting movement provided by the biasing mechanism 146.

Similar to the various other components of the mill 10, it is entirely within the ambit of the present invention to utilize other variously configured belt tensioning devices. For example, the device may alternatively comprise a unique turnbuckle assembly having a large square-shaped tube with internally threaded caps receiving threaded rods fixed to the motor and the swingable arm. It is also possible to use a tensioning device comprising a series of interchangeable, fixed length rods that are pivotally connected between the motor and swingable arm, with the length of the rod used depending upon the amount of slack in the belt.

The operation of the mill 10 should be apparent from the foregoing description. Thus, it shall be sufficient to explain that the material from the hopper 42 is controllably fed to the nip 16 by the feeder 44. The illustrated rolls 12 and 14 serve to press the material into flakes. If a large foreign object is delivered to the nip 16, the shiftable roll 12 moves against the bias of the spring relief 66 so that the object may pass through the nip 16 without damaging rolls 12,14. Of course, the motor 88 shifts with the roll 12, with the tensioning device 166 maintaining the proper tension on the belt 98 during such shifting movement. If it is desired to adjust the nip 16, the piston and cylinder assemblies 62 and 64 are retracted to decrease the nip 16 or the pressure is relieved in the assembly 62 and 64 so that the biasing mechanism 146 may shift the motor 88 and roll 12 in a direction to increase the nip 16.

It is particularly noted that the drives 72 and 74 are nearly identical, in the sense that they utilize the same size motors and sheaves. Not only does this make these drive components interchangeable between the drives, it also makes it easier to operate the rolls 12,14 at the same speed. However, the use of separate drives also facilitates operation of the rolls at different speeds (e.g., in a roller mill application). It should also be noted that the rotation directional of the rolls 12,14 may easily be reversed (e.g., in a clogged or blocked nip situation).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A material processing mill comprising:

a pair of rotatable rolls defining a material processing nip therebetween, at least one of the rolls being shiftable relative to the other so that the nip defined between the rolls is variable; and a pair of drives each configured to rotate a respective one of the rolls, wherein each of the drives includes a motor, a rotatable drive member drivingly connected to the motor, a rotatable driven member fixed relative to the respective one of the rolls, and an endless positive drive element that drivingly interconnects the driven member to the drive member, said positive drive element including a cogged belt, said drive for said at least one of the rolls including a motor base that supports the motor, said motor base including a shiftable carrier to which the motor is fixed so that the motor is free to shift while rotating said at least one of the rolls, said drive for said at least one of the rolls including an adjustable slack takeup device operable to tension the belt, said slack takeup device adjustably fixing the motor relative to said at least one of the rolls so that the spacing between the motor and said at least one of the rolls is variable, wherein the motor and said at least one of the rolls shift together except when the slack takeup device is adjusted to vary the spacing therebetween.

2. A material processing mill as claimed in claim 1, said motor base including a biasing mechanism configured to yieldably bias the motor in a first direction.

3. A material processing mill as claimed in claim 2, said motor being spaced from said at least one of the rolls in said first direction.

4. A material processing mill comprising:

a pair of rotatable rolls defining a material processing nip therebetween;

at least one of the rolls being shiftable relative to the other so that the nip defined between the rolls is variable, a pair of drives each configured to rotate a respective one of the rolls, wherein each of the drives includes a motor, a rotatable drive member drivingly connected to the motor, a rotatable driven member fixed relative to the respective one of the rolls, and an endless positive drive element that drivingly interconnects the driven member to the drive member, said positive drive element including a cogged belt, said drive for said at least one of the rolls including a motor base that supports the motor, said motor base including a shiftable carrier to which the motor is fixed so that the motor is free to shift while rotating said at least one of the rolls, said motor base including a biasing mechanism configured to yieldably bias the motor in a first direction; and a roll positioning mechanism operable to shift said at least one of the rolls among a plurality of positions, said roll positioning mechanism including a single acting piston and cylinder assembly for effecting shifting of said at least one of the rolls in a second direction, with the first and second directions being generally opposite.

5. A material processing mill comprising:

a pair of rotatable rolls defining a material processing nip therebetween, at least one of the rolls being shiftable relative to the other so that the nip defined between the rolls is variable; and a drive for rotating said at least one of the rolls, said drive including a motor drivingly connected to said at least one of the rolls and a motor base that supports the motor, said motor base including a shiftable carrier to which the motor is fixed so that the motor is free to shift while rotating said at least one of the rolls, said motor being fixed relative to said at least one of the rolls so that the motor and said at least one of the rolls shift together.

6. A material processing mill as claimed in claim 5; and a roll positioning mechanism operable to shift said at least one of the rolls among a plurality of positions.

7. A material processing mill as claimed in claim 6, said roll positioning mechanism including a spring relief that yieldably maintains said at least one of the rolls in the position to which said at least one of the rolls has been shifted.

8. A material processing mill comprising:

a pair of rotatable rolls defining a material processing nip therebetween, at least one of the rolls being shiftable relative to the other so that the nip defined between the rolls is variable; and a drive for rotating said at least one of the rolls, said drive including a motor drivingly connected to said at least one of the rolls and a motor base that supports the motor, said motor base including a shiftable carrier to which the motor is fixed so that the motor is free to shift while rotating said at least one of the rolls, said drive including a rotatable drive member drivingly connected to the motor, a rotatable driven member spaced from the drive member and fixed relative to said at least one of the rolls, and an endless element that drivingly interconnects the driven member to the drive member when suitably tensioned, said drive further including an adjustable slack takeup device operable to suitably tension the endless element, said slack takeup device adjustably fixing the motor relative to said at least one of the rolls so that the spacing between the motor and said at least one of the rolls is variable, wherein the motor and said at least one of the rolls shift together except when the slack takeup device is adjusted to vary the spacing therebetween.

9. A material processing mill as claimed in claim 8; and a frame on which the rolls and roll drive are supported, said base including a mount that is fixed to the frame and shiftably supports the carrier.

10. A material processing mill as claimed in claim 9, said mount including a rail and said carrier including a sleeve slidably received on the rail.

11. A material processing mill as claimed in claim 8, said motor base including a biasing mechanism configured to yieldably bias the motor in a first direction.

12. A material processing mill as claimed in claim 11, said motor being spaced from said at least one of the rolls in said first direction.

13. A material processing mill comprising:

a pair of rotatable rolls defining a material processing nip therebetween, at least one of the rolls being shiftable relative to the other so that the nip defined between the rolls is variable, a drive for rotating said at least one of the rolls, said drive including a motor drivingly connected to said at least one of the rolls and a motor base that supports the motor, said motor base including a shiftable carrier to which the motor is fixed so that the motor is free to shift while rotating said at least one of the rolls.

said motor base including a biasing mechanism configured to yieldably bias the motor in a first direction; and a roll positioning mechanism operable to shift said at least one of the rolls among a plurality of positions, said roll positioning mechanism including a single acting piston and cylinder assembly for effecting shifting of said at least one of the rolls in a second direction, with the first and second directions being generally opposite.

14. A material processing mill comprising:

first and second rotatable rolls defining a material processing nip therebetween, with the first roll being shiftable relative to the second roll so that the nip defined between the rolls is adjustable;

a roll positioning mechanism operable to shift the first roll among a plurality of positions, said roll positioning mechanism including a spring relief that yieldably maintains the first roll in the position to which the first roll has been shifted; and first and second drives each configured to rotate a respective one of the first and second rolls, with the first drive including a first motor drivingly connected to the first roll and a first motor base that supports the first motor, said first motor base including a shiftable carrier to which the first motor is fixed so that the first motor is free to shift while rotating the first roll, said first drive including an endless element that drivingly interconnects the first roll to the first motor when suitably tensioned, said first drive further including an adjustable slack takeup device operable to suitably tension the endless element, said slack takeup device adjustably fixing the first motor relative to the first roll so that the spacing between the first motor and the first roll is variable, wherein the first motor and the first roll shift together except when the slack takeup device is adjusted to vary the spacing therebetween.

15. A material processing mill as claimed in claim 14, said second drive including a fixed second motor drivingly connected to the second roll.

16. A material processing mill as claimed in claim 15, said first drive including a first cogged belt drivingly interconnecting the first roll to the first motor, said second drive including a second cogged belt drivingly interconnecting the second roll to the second motor.

17. A material processing mill as claimed in claim 14, said first motor base including a biasing mechanism configured to yieldably bias the first motor in a biasing direction.

18. A material processing mill as claimed in claim 17, said first motor being spaced from the first roll in said biasing direction.

19. A material processing mill comprising:

first and second rotatable rolls defining a material processing nip therebetween, with the first roll being shiftable relative to the second roll so that the nip defined between the rolls is adjustable;

a roll positioning mechanism operable to shift the first roll among a plurality of positions, said roll positioning mechanism including a spring relief that yieldably maintains the first roll in the position to which the first roll has been shifted, first and second drives each configured to rotate a respective one of the first and second rolls, with the first drive including a first motor drivingly connected to the first roll and a first motor base that supports the first motor, said first motor base including a shiftable carrier to which the first motor is fixed so that the first motor is free to shift while rotating the first roll, said first motor base including a biasing mechanism configured to yieldably bias the first motor in a biasing direction; and a roll positioning mechanism operable to shift the first roll among a plurality of positions, said roll positioning mechanism including a single acting piston and cylinder assembly for effecting shifting of the first roll in a powered direction, with the biasing and powered directions being generally opposite.

* * * * *